US011230904B2

(12) United States Patent
Al-Mousa et al.

(10) Patent No.: US 11,230,904 B2
(45) Date of Patent: Jan. 25, 2022

(54) SETTING AND UNSETTING A PRODUCTION PACKER

(71) Applicant: Saudi Arabian Oil Company, Dhahran (SA)

(72) Inventors: Ahmed Al-Mousa, Dhahran (SA); Ahmed A. Al-Ramadhan, Dammam (SA); Qadir Looni, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 164 days.

(21) Appl. No.: 16/679,949

(22) Filed: Nov. 11, 2019

(65) Prior Publication Data

US 2021/0140267 A1 May 13, 2021

(51) Int. Cl.
*E21B 33/1295* (2006.01)
*E21B 33/12* (2006.01)
*E21B 33/129* (2006.01)

(52) U.S. Cl.
CPC ..... *E21B 33/1295* (2013.01); *E21B 33/1208* (2013.01); *E21B 33/1293* (2013.01)

(58) Field of Classification Search
CPC ..... E21B 33/1208; E21B 33/1293; E21B 33/1295
See application file for complete search history.

(56) References Cited

U.S. PATENT DOCUMENTS 880,404 A 2/1908 Sanford
1,591,264 A 7/1926 Baash
1,789,993 A 1/1931 Switzer
1,896,482 A 2/1933 Crowell
1,949,498 A 3/1934 Frederick et al.
2,121,002 A 6/1938 Baker
2,121,051 A 6/1938 Ragan et al.
2,187,487 A 1/1940 Burt
2,189,697 A 2/1940 Baker
(Continued)

FOREIGN PATENT DOCUMENTS

AU 636642 5/1993
AU 2007249417 11/2007
(Continued)

OTHER PUBLICATIONS

Bruton et al., "Whipstock Options for Sidetracking," Oilfield Review, vol. 26, No. 1, Spring 2014, 10 pages.
(Continued)

*Primary Examiner* — Kristyn A Hall
(74) *Attorney, Agent, or Firm* — Fish & Richardson P.C.

(57) ABSTRACT

A packer assembly includes a tubing string disposed in a wellbore and a packer releasably coupled to the tubing string. The packer includes a housing releasably coupled to the tubing string, a packer slip, a flexible sealing element, a piston coupled to the housing, a locking member, and a mandrel disposed inside the housing. The piston moves to activate the packer slip and the flexible sealing element to set the packer on a wall of the wellbore. The locking member engages the piston to constrain movement of the piston to keep the packer set on the wall of the wellbore. The mandrel connects to the tubing string when the tubing string is released from the housing. The locking member is collapsible to disengage the piston to unset the packer slip and the flexible sealing element responsive to shear force applied by the mandrel to the locking member.

19 Claims, 8 Drawing Sheets

(56) References Cited

U.S. PATENT DOCUMENTS

| | | | |
|---|---|---|---|
| 2,222,233 | A | 11/1940 | Mize |
| 2,286,075 | A | 6/1942 | Evans |
| 2,304,793 | A | 12/1942 | Bodine |
| 2,316,402 | A | 4/1943 | Canon |
| 2,327,092 | A | 8/1943 | Botkin |
| 2,411,260 | A | 11/1946 | Glover et al. |
| 2,546,978 | A | 4/1951 | Collins et al. |
| 2,672,199 | A | 3/1954 | McKenna |
| 2,707,998 | A | 5/1955 | Baker et al. |
| 2,728,599 | A | 12/1955 | Moore |
| 2,751,010 | A | 6/1956 | Trahan |
| 2,881,838 | A | 4/1959 | Morse et al. |
| 2,912,053 | A | 11/1959 | Bruekelman |
| 2,912,273 | A | 11/1959 | Chadderdon et al. |
| 2,915,127 | A | 12/1959 | Abendroth |
| 2,965,175 | A | 12/1960 | Ransom |
| 2,965,177 | A | 12/1960 | Le Bus et al. |
| 3,116,799 | A | 1/1964 | Lemons |
| 3,147,536 | A | 9/1964 | Lamphere |
| 3,225,828 | A | 12/1965 | Wisenbaker et al. |
| 3,369,603 | A | 2/1968 | Trantham |
| 3,381,748 | A | 5/1968 | Peters et al. |
| 3,382,925 | A | 5/1968 | Jennings |
| 3,667,721 | A | 6/1972 | Vujasinovic |
| 3,897,038 | A | 7/1975 | Le Rouax |
| 3,915,426 | A | 10/1975 | Le Rouax |
| 4,030,354 | A | 6/1977 | Scott |
| 4,042,019 | A | 8/1977 | Henning |
| 4,059,155 | A | 11/1977 | Greer |
| 4,099,699 | A | 7/1978 | Allen |
| 4,190,112 | A | 2/1980 | Davis |
| 4,254,983 | A | 3/1981 | Harris |
| 4,276,931 | A | 7/1981 | Murray |
| 4,285,400 | A | 8/1981 | Mullins |
| 4,289,200 | A | 9/1981 | Fisher |
| 4,296,822 | A | 10/1981 | Ormsby |
| 4,349,071 | A | 9/1982 | Fish |
| 4,391,326 | A | 7/1983 | Greenlee |
| 4,407,367 | A | 10/1983 | Kydd |
| 4,412,130 | A | 10/1983 | Winters |
| 4,413,642 | A | 11/1983 | Smith et al. |
| 4,422,948 | A | 12/1983 | Corley et al. |
| 4,538,684 | A | 9/1985 | Sheffield |
| 4,562,888 | A | 1/1986 | Collet |
| 4,611,658 | A | 9/1986 | Salerni et al. |
| 4,696,502 | A | 9/1987 | Desai |
| 4,791,992 | A | 12/1988 | Greenlee et al. |
| 4,834,184 | A | 5/1989 | Streich et al. |
| 4,869,321 | A | 9/1989 | Hamilton |
| 4,898,245 | A | 2/1990 | Braddick |
| 4,953,617 | A | 9/1990 | Ross et al. |
| 5,012,863 | A | 5/1991 | Springer |
| 5,117,909 | A | 6/1992 | Wilton et al. |
| 5,129,956 | A | 7/1992 | Christopher et al. |
| 5,176,208 | A | 1/1993 | Lalande et al. |
| 5,197,547 | A | 3/1993 | Morgan |
| 5,295,541 | A | 3/1994 | Ng et al. |
| 5,330,000 | A | 7/1994 | Givens et al. |
| 5,358,048 | A | 10/1994 | Brooks |
| 5,507,346 | A | 4/1996 | Gano et al. |
| 5,580,114 | A | 12/1996 | Palmer |
| 5,678,635 | A | 10/1997 | Dunlap et al. |
| 5,833,001 | A | 11/1998 | Song et al. |
| 5,842,518 | A | 12/1998 | Soybel et al. |
| 5,924,489 | A | 7/1999 | Hatcher |
| 5,944,101 | A | 8/1999 | Hearn |
| 6,138,764 | A | 10/2000 | Scarsdale et al. |
| 6,276,452 | B1 | 8/2001 | Davis et al. |
| 6,371,204 | B1 | 4/2002 | Singh et al. |
| 6,491,108 | B1 | 12/2002 | Slup et al. |
| 6,595,289 | B2 | 7/2003 | Tumlin et al. |
| 6,688,386 | B2 | 2/2004 | Cornelssen |
| 6,768,106 | B2 | 7/2004 | Gzara et al. |
| 6,808,023 | B2 | 10/2004 | Smith et al. |
| 6,899,178 | B2 | 5/2005 | Tubel |
| 7,049,272 | B2 | 5/2006 | Sinclair et al. |
| 7,096,950 | B2 | 8/2006 | Howlett et al. |
| 7,117,956 | B2 | 10/2006 | Grattan et al. |
| 7,188,674 | B2 | 3/2007 | McGavern, III et al. |
| 7,188,675 | B2 | 3/2007 | Reynolds |
| 7,231,975 | B2 | 6/2007 | Lavaure et al. |
| 7,249,633 | B2 | 7/2007 | Ravensbergen et al. |
| 7,284,611 | B2 | 10/2007 | Reddy et al. |
| 7,405,182 | B2 | 7/2008 | Verrett |
| 7,424,909 | B2 | 9/2008 | Roberts et al. |
| 7,488,705 | B2 | 2/2009 | Reddy et al. |
| 7,497,260 | B2 | 3/2009 | Telfer |
| 7,591,305 | B2 | 9/2009 | Brookey et al. |
| 7,600,572 | B2 | 10/2009 | Slup et al. |
| 7,712,527 | B2 | 5/2010 | Roddy |
| 7,762,323 | B2 | 7/2010 | Frazier |
| 7,802,621 | B2 | 9/2010 | Richards et al. |
| 7,934,552 | B2 | 5/2011 | La Rovere |
| 7,965,175 | B2 | 6/2011 | Yamano |
| 8,002,049 | B2 | 8/2011 | Keese et al. |
| 8,453,724 | B2 | 6/2013 | Zhou |
| 8,496,055 | B2 | 7/2013 | Mootoo et al. |
| 8,579,024 | B2 | 11/2013 | Mailand et al. |
| 8,770,276 | B1 | 7/2014 | Nish et al. |
| 9,109,433 | B2 | 8/2015 | DiFoggio et al. |
| 9,133,671 | B2 | 9/2015 | Kellner |
| 9,212,532 | B2 | 12/2015 | Leuchtenberg et al. |
| 9,359,861 | B2 | 6/2016 | Burgos |
| 9,410,066 | B2 | 8/2016 | Ghassemzadeh |
| 9,416,617 | B2 | 8/2016 | Wiese et al. |
| 9,574,417 | B2 | 2/2017 | Laird et al. |
| 9,657,213 | B2 | 5/2017 | Murphy et al. |
| 10,280,706 | B1 | 5/2019 | Sharp, III |
| 2002/0053428 | A1 | 5/2002 | Maples |
| 2003/0047312 | A1 | 3/2003 | Bell |
| 2003/0132224 | A1 | 7/2003 | Spencer |
| 2005/0167097 | A1 | 8/2005 | Sommers et al. |
| 2007/0137528 | A1 | 6/2007 | Le Roy-Ddelage et al. |
| 2007/0181304 | A1 | 8/2007 | Rankin et al. |
| 2008/0236841 | A1 | 10/2008 | Howlett et al. |
| 2008/0251253 | A1 | 10/2008 | Lumbye |
| 2009/0194290 | A1 | 8/2009 | Parks et al. |
| 2009/0250220 | A1 | 10/2009 | Stamoulis |
| 2010/0270018 | A1 | 10/2010 | Howlett |
| 2011/0036570 | A1 | 2/2011 | La Rovere et al. |
| 2011/0067869 | A1 | 3/2011 | Bour et al. |
| 2011/0278021 | A1 | 11/2011 | Travis et al. |
| 2012/0012335 | A1 | 1/2012 | White et al. |
| 2012/0118571 | A1 | 5/2012 | Zhou |
| 2012/0170406 | A1 | 7/2012 | DiFoggio et al. |
| 2013/0240207 | A1 | 9/2013 | Frazier |
| 2013/0296199 | A1 | 11/2013 | Ghassemzadeh |
| 2016/0237810 | A1 | 8/2016 | Beaman et al. |
| 2016/0281458 | A1 | 9/2016 | Greenlee |
| 2016/0305215 | A1 | 10/2016 | Harris et al. |
| 2017/0044864 | A1 | 2/2017 | Sabins et al. |
| 2017/0058628 | A1 | 3/2017 | Van Wijk et al. |
| 2017/0067313 | A1 | 3/2017 | Connell et al. |
| 2018/0187498 | A1 | 7/2018 | Soto et al. |
| 2018/0245427 | A1 | 8/2018 | Jimenez et al. |
| 2019/0024473 | A1 | 1/2019 | Arefi |

FOREIGN PATENT DOCUMENTS

| | | |
|---|---|---|
| CA | 2734032 | 6/2016 |
| DK | 2236742 | 8/2017 |
| GB | 2021178 | 11/1979 |
| GB | 2392183 | 2/2004 |
| GB | 2492663 | 1/2013 |
| WO | WO 1989012728 | 12/1989 |
| WO | WO 2002090711 | 11/2002 |
| WO | WO 2010132807 | 11/2010 |

(56) References Cited

FOREIGN PATENT DOCUMENTS

| | | |
|---|---|---|
| WO | WO 2012164023 | 12/2012 |
| WO | WO 2019132877 | 7/2019 |

OTHER PUBLICATIONS

Scribd [online], "Milling Practices and Procedures," retrieved from URL <https://www.scribd.com/document/358420338/Milling-rev-2-Secured>, 80 pages.

Tam International Inflatable and Swellable Packers, "TAM Scab Liner brochure," Tam International, available on or before Nov. 15, 2016, 4 pages.

PCT International Search Report and Written Opinion in International Appln. No. PCT/US2020/059867, dated Feb. 22, 2021, 15 pages.

SETTING AND UNSETTING A PRODUCTION PACKER

FIELD OF THE DISCLOSURE

This disclosure relates to packers, in particular, to production packers.

BACKGROUND OF THE DISCLOSURE

Production packers are sealing devices used to isolate and contain produced fluids within a tubing string. Production packers are deployed, with the tubing string, to a downhole location of a wellbore for production. Setting and unsetting production packers on a wellbore can be costly and time-consuming.

SUMMARY

Implementations of the present disclosure include a packer assembly that includes a tubing string configured to be disposed in a wellbore and a packer releasably coupled to the tubing string. The packer includes a housing releasably coupled to the tubing string, a packer slip coupled to the housing, and a flexible sealing element coupled to the housing. The packer also includes a movable piston coupled to the housing. The movable piston is configured to move to activate the packer slip and the flexible sealing element to set the packer slip and the flexible sealing element on a wall of the wellbore. The packer also includes a locking member coupled to the housing. The locking member is configured to engage the piston to constrain movement of the piston to keep the packer slip and the flexible sealing element set on the wall of the wellbore. The packer also includes a mandrel disposed inside the housing. The mandrel is configured to connect to the tubing string when the tubing string is released from the housing. The locking member is collapsible to disengage the piston to unset the packer slip and the flexible sealing element responsive to shear force applied by the mandrel to the locking member.

In some implementations, the movable piston includes engageable teeth on a surface of the piston, wherein the locking member is configured to engage the engageable teeth of the movable piston to constrain the movable piston to movement in one direction. In some implementations, the movable piston is configured to move in the one direction parallel to a longitudinal axis of the packer to activate the packer slip and the flexible sealing element, and the mandrel is configured to move in a same or opposite direction to the movable piston, parallel to the longitudinal axis of the packer to apply shear force to the locking member. In some implementations, the tubing string is configured to be threadedly connected to the mandrel to pull the mandrel in the direction parallel to the longitudinal axis of the packer to collapse the locking member. In some implementations, the locking member includes a locking ring defining teeth extending from an outer surface of the locking ring. The teeth are configured to engage the engageable teeth of the movable piston to constrain the movable piston to movement in the one direction as the piston activates the packer slip and the flexible sealing element.

In some implementations, the locking member includes a locking ring and the housing includes a radial gap configured to engage the locking ring when the mandrel applies shear force to the locking ring to collapse the locking ring. In some implementations, the locking ring is force fitted around the mandrel. The locking ring includes a gap with a width configured to decrease to reduce an outer diameter of the ring responsive to disengaging at least part of the mandrel.

In some implementations, the packer assembly further includes a connection assembly attached to an end of the tubing string. The housing of the packer is releasably is attached, with shear pins, to the connection assembly. The connection assembly includes a threaded end extending beyond the shear pins into the housing and configured to connect to a threaded end of the mandrel when the tubing string is released from the housing.

In some implementations, the piston is configured to be activated by fluidic pressure. The housing includes a fluid channel containing the piston and is configured to flow fluid to move the piston.

In some implementations, the piston is disposed within a channel of the housing. The piston defines a tapered shoulder extending from a body of the piston, with the packer slip and the flexible sealing element disposed along the channel. The tapered shoulder of the piston is configured to move the packer slip to set the packer slip on the wall of the wellbore as the piston moves along the channel. An end of the piston is configured to push the flexible sealing element to set the sealing element on the wall of the wellbore as the piston moves along the channel.

Implementations of the present disclosure include a method including activating a slip of a packer and a flexible sealing element of the packer to set the packer on a wall of a wellbore. The packer is disposed in a downhole location of the wellbore. The packer includes a housing configured to releasably engage a tubing string disposed in the wellbore. The packer further including the slip, the flexible sealing element, a piston configured to move to activate the packer slip and the flexible sealing element, a locking member configured to engage the piston to constrain movement of the piston, and a mandrel disposed inside the housing. The locking member is collapsible to disengage the piston to unset the packer slip and the flexible sealing element responsive to shear force applied by the mandrel to the locking member. Activating the slip and the flexible sealing element includes moving the piston to engage the slip and the flexible sealing element. The method also includes engaging, by the locking member, the piston to prevent the piston from disengaging the slip and the flexible sealing element set on the wall of the wellbore. The method also includes collapsing, by the mandrel, the locking member to disengage the piston to unset the slip and the flexible sealing element from the wall of the wellbore.

In some implementations, the method further includes, prior to collapsing the locking member, engaging, by the mandrel, the tubing string when the tubing string is released from the housing to move with the tubing string. Collapsing the locking member includes moving the mandrel, by the tubing string, along a longitudinal axis of the packer with the housing engaging the locking member. In some implementations, the locking member includes a locking ring and the housing includes a radial gap configured to engage the locking ring when the mandrel applies shear force to the locking ring to collapse the locking ring. Collapsing the locking member includes moving the mandrel along the longitudinal axis of the packer until at least part of the mandrel disengages the locking ring.

In some implementations, the piston includes engageable teeth on a surface of the piston, and engaging the piston include engaging the engageable teeth of the piston to constrain the piston to movement in one direction.

In some implementations, the method further includes, prior to collapsing the locking member, releasing the housing from the tubing string by breaking, under shear force, shear pins holding the locking member to the tubing string.

In some implementations, the piston is disposed within and is movable along a channel of the housing. The slip is disposed along the channel, and activating the slip includes moving the piston along a one-way direction along the channel to engage the slip to set the slip on the wall of the wellbore.

Implementations of the present disclosure include a production packer including a tubular housing configured to be disposed in a wellbore. The tubular housing is configured to be releasably coupled to a tubing string disposed in the wellbore. The packer also includes a packer slip coupled to the tubular housing, and a flexible sealing element coupled to the tubular housing. The packer also includes a movable piston coupled to the tubular housing. The movable piston is configured to move to activate the packer slip and the flexible sealing element to set the packer slip and the flexible sealing element on a wall of the wellbore. The packer also includes a locking member coupled to the tubular housing. The locking member is configured to engage the piston to constrain movement of the piston. The packer also includes a mandrel disposed inside the tubular housing. The mandrel is configured to connect to the tubing string when the tubing string is released from the tubular housing. The locking member is collapsible to disengage the piston to unset the packer slip and the flexible sealing element responsive to shear force applied by the mandrel to the locking member.

In some implementations, the movable piston includes engageable teeth on a surface of the piston. The locking member is configured to engage the engageable teeth of the movable piston to constrain the movable piston to movement in one direction. In some implementations, the movable piston is configured to move in the one direction parallel to a longitudinal axis of the packer to activate the packer slip and the flexible sealing element. The mandrel is configured to move in a direction parallel to the longitudinal axis of the packer to apply shear force to the locking member.

In some implementations, the locking member includes a locking ring and the housing includes a radial gap configured to engage the locking ring when the mandrel applies shear force to the locking ring to collapse the locking ring.

DETAILED DESCRIPTION OF THE DISCLOSURE

The present disclosure describes a packer assembly that allows a tubing string to set and unset a production packer in one trip. The production packer is releasably coupled to the tubing string. The production packer can be set on a downhole location of a wellbore by applying fluidic pressure, through the tubing string, to the packer. The fluidic pressure moves pistons that set the slips and the flexible sealing element of the packer. Locking members of the packer constrain movement of the pistons to one direction to keep the packer set on the wellbore. The tubing string is released from the packer to test the packer and then lowered to engage the packer to initiate production. After a few years of production, the packer can be removed during a workover operation by further lowering the tubing string to engage an internal mandrel of the packer. The tubing string pulls the internal mandrel of the packer to shear off the locking members holding the pistons and release the slips and the flexible sealing element from the wellbore. With the slips and the flexible sealing element disengaged, the packer can be retrieved from the wellbore.

Particular implementations of the subject matter described in this specification can be implemented so as to realize one or more of the following advantages. For example, setting and unsetting a production packer in one trip saves rig time and resources.

Figure 1:
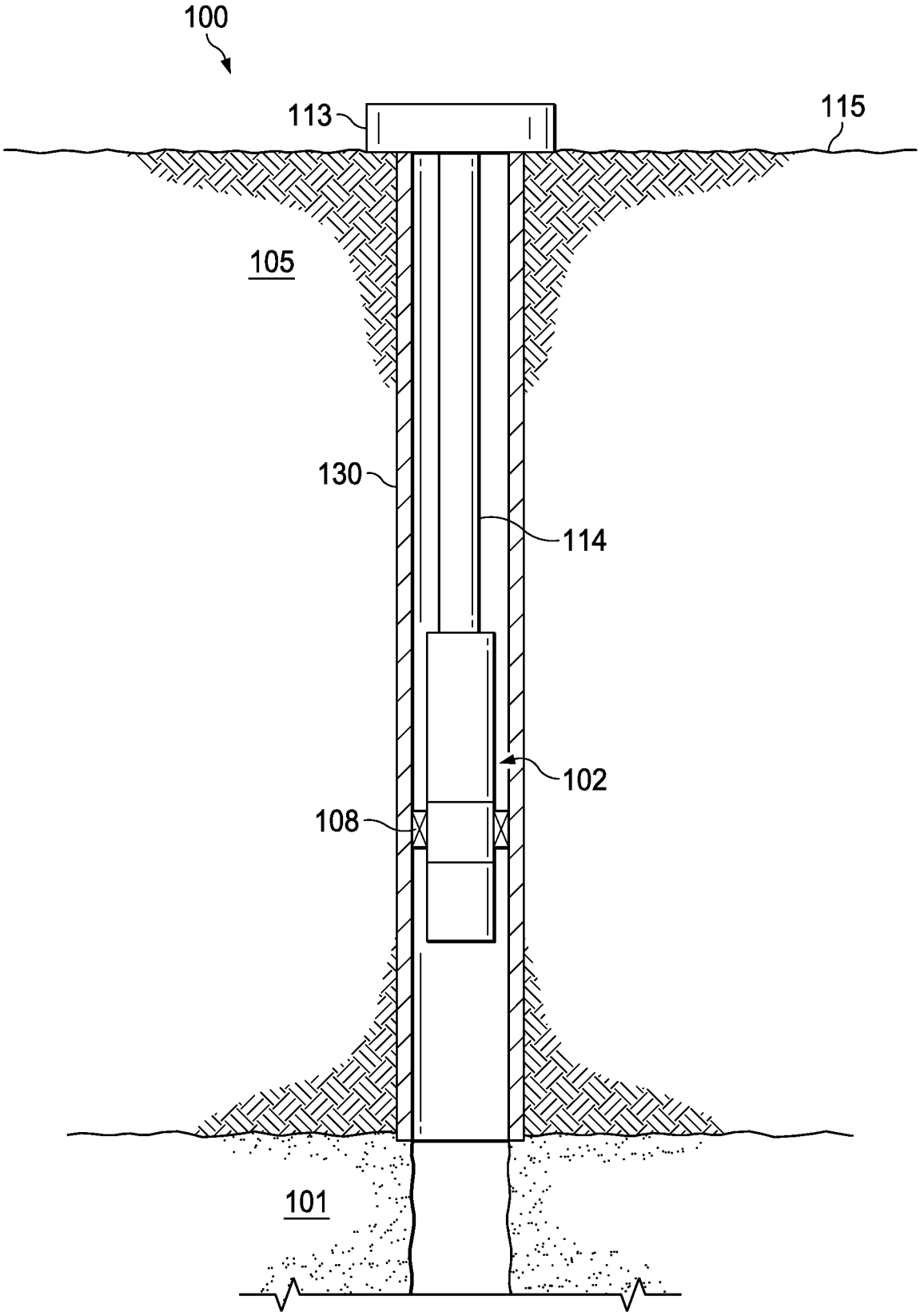
FIG. 1 is a front schematic view of a packer assembly disposed in a wellbore.

FIG. 1 shows a packer assembly 100 disposed in a wellbore 130. The packer assembly 100 includes a tubing string 114 (for example, a completion or testing string) and a packer 102 (for example, a production packer) fluidically coupled to the tubing string 114. The tubing string extends from a surface 115 of the wellbore 130 into the wellbore 130 to position the packer 102 at a downhole location of the wellbore 130. At the surface 115, a wellhead 113 supports the tubing string 114 within the wellbore 130 that has been formed in a geologic formation 105. The geologic formation 105 includes a hydrocarbon reservoir 101 from which hydrocarbons can be extracted. The packer 102 resides at the downhole end of the tubing string 114. As further described in detail later with respect to FIG. 2, the tubing string 114 can be used to set and unset the packer 102 on the wellbore 130 in one trip.

Figure 2:
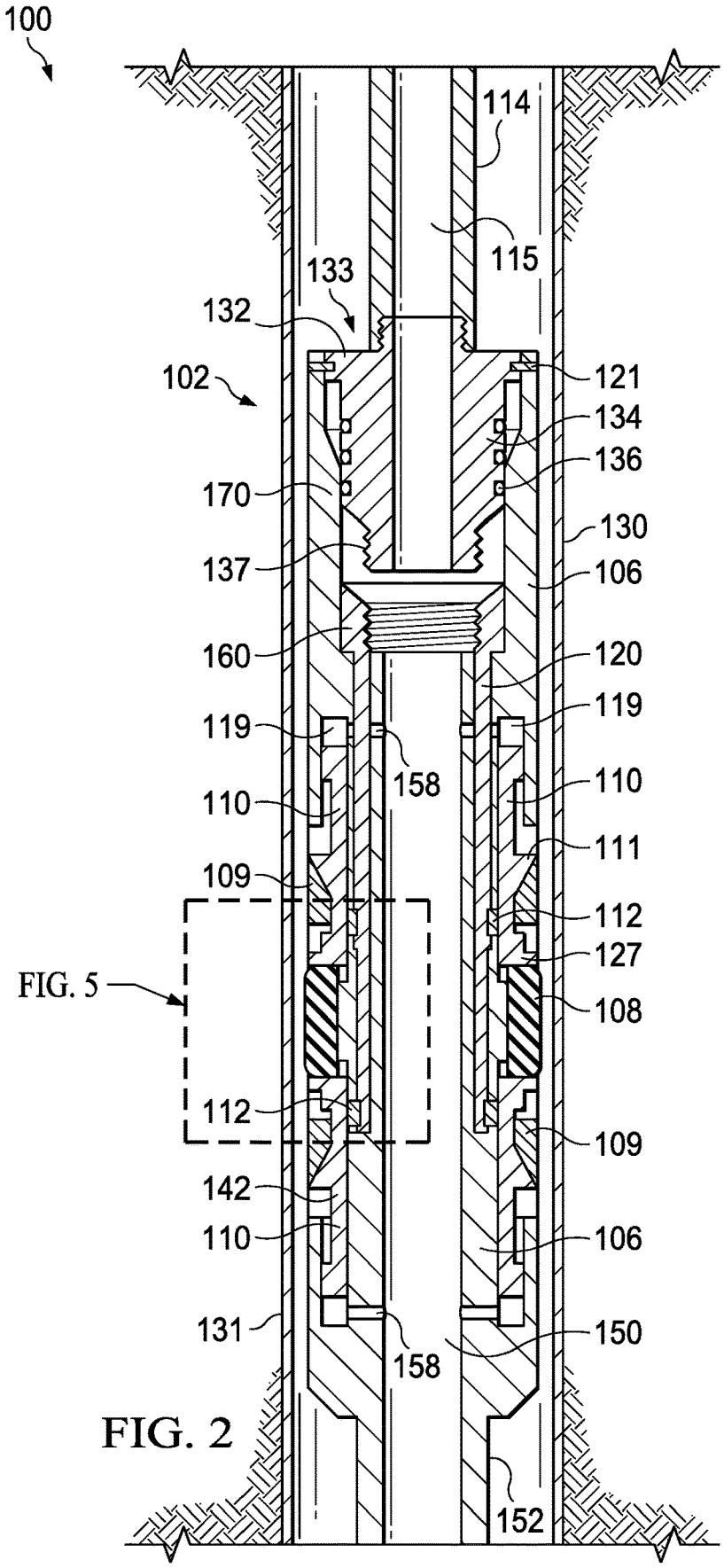
FIG. 2 is a schematic cross-sectional front view of a packer according to implementations of the present disclosure.

FIG. 2 shows a portion of the packer assembly 100, with the packer 102 positioned at the downhole location of the wellbore 130 where the packer 102 can be set for production purposes. The packer assembly further includes a connection assembly 133 (for example, a packer running sub) attached to an end of the tubing string 114. The packer 102 is releasably coupled, through the connection assembly 133, to the tubing string 114. For example, the packer 102 can be releasably attached to the connection assembly 133 with shear pins 121. With the packer 102 attached to the tubing string 114, the tubing string 114 is in fluid communication with an interior channel 150 of the packer 102 to flow fluid from and into the packer 102.

The packer 102 includes a housing 106 (for example, a tubular housing) that connects the packer 102 to the tubing string 114. The housing protects the internal components of the packer 102. The packer 102 can include one or more packer slips 109 coupled to the housing 106, a flexible sealing element 108 (for example, a sealing rubber cylinder) coupled to the housing 106, multiple movable pistons 110 disposed and movable along a channel 119 (for example, a fluid channel) of the housing 106, one or more locking members 112 (for example, locking rings), and an internal mandrel 120 disposed inside the housing 106.

The packer 102 can include a first set of pistons 110 disposed on a first side of the sealing element 108 and a second set of pistons 110 disposed on a second side opposite the first side of the sealing element 108. Each set of pistons 110 moves toward the flexible sealing element 108 in a direction parallel to a longitudinal axis of the packer 102. The multiple pistons 110 activate the sealing element 108 and the packer slips 109 to set the packer on a wall 131 (for example, a cased wall) of the wellbore 130. The sealing element 108 resides between a first set of packer slips 109 and a second set of packer slips 109. Each packer slip 109 is disposed along a respective channel 119 where the piston moves 110 to activate the slips 109. The flexible sealing element 108 is disposed at a common end of the channels 119 to be activated by the multiple movable pistons 110. For example, at least a portion of each packer slip 109 is disposed in a respective channel 119 (for example, along a pathway of each piston 110) and the sealing element 108 is disposed around a portion of the housing 106 at an end of the channels 119.

Each piston 110 defines a tapered shoulder 111 that extends from a body 142 of the piston 110 in the direction of the packer slip 109. The tapered shoulder 111 bears against a surface of the slip 109 tapered in a corresponding, opposite direction to move the packer slip 109 toward the wall 131 of the wellbore 130. Thus, as the piston 110 moves along the channel 119 toward the sealing element 108, the tapered shoulder 111 of the piston 110 activates a corresponding packer slip 109 to set the packer slip 109 on the wall 131 of the wellbore 130. An end 127 of each piston pushes (for example, expands or activates) the flexible sealing element 108 as the piston moves along the channel 119 to set the sealing element 108 on the wall 131 of the wellbore 130.

Each piston 110 can be activable by hydraulic pressure applied at the channel 119. For example, a tailpipe 152 of the packer 102 can be plugged (for example, by deploying a ball or a plugging element that sits on a fluid outlet of the tailpipe) that allows fluid flown by the tubing string 114 to pressurize the packer 102. The pressurized fluid in the internal channel 150 of the packer 102 enters the channels 119 through ports 158 of the housing 106 to push the pistons 110 disposed in the channels 119. The pistons 110 move to set the slips 109 on the wall 131 (for example, on the casing of the wellbore 130) and to extrude the sealing element 108 to form a seal at the downhole location of the wellbore 130. The mandrel 120 can include corresponding holes that allow fluid to enter the channels 119 to move the pistons 110. As further described in detail later with respect to FIG. 5, the pistons 110 are constrained to one-way movement by the locking members 112 of the packer 102. The locking members 112 lock the pistons 110 in place to keep the sealing element 108 and the slips 109 set on the wall 131 of the wellbore 130 after the fluidic pressure is released. By one-way movement, it is meant that each piston 110 moves in one straight direction, and the locking members 112 prevent each piston 110 from moving in an opposite direction to the one straight direction.

The connection assembly 133 includes a seal assembly 134 that extends beyond a flange 132 of the connection assembly 133 into the housing 106 of the packer 102. The flange 132 is connected, with shear pins 121, to an end of the housing 106. The seal assembly 134 includes a cylindrical body with O-rings 136 disposed on the outer surface of the body to form a fluid seal with a polished bore receptacle 170 of the housing 106.

Figure 3:
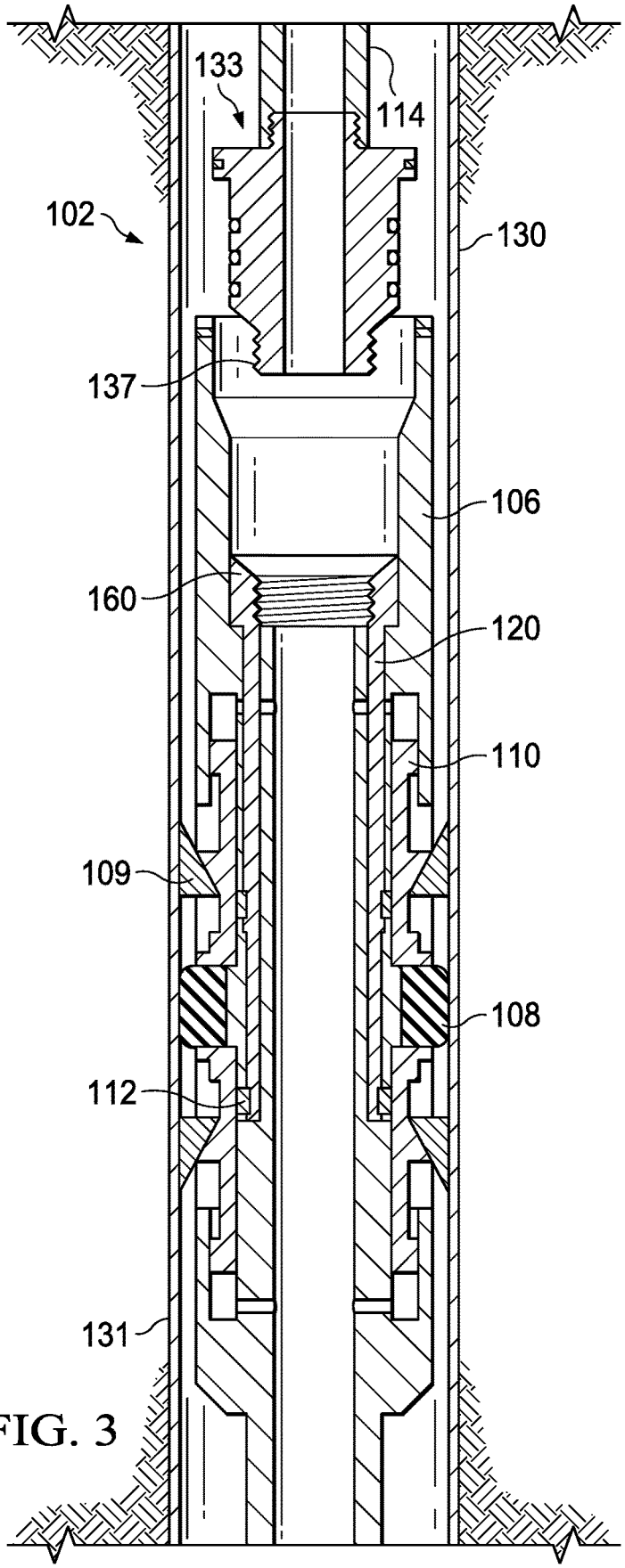
FIG. 3 is a schematic cross-sectional front view of the packer of FIG. 2, released from a tubing string.

Also referring to FIG. 3, once the packer 102 is set on the wellbore 130 and the tubing-casing-annulus is pressure tested, the connection assembly 133 can be disengaged by applying over-pull to the tubing string 114 to shear off the pins 121 of the connection assembly 133. With the shear pins 121 broken, the tubing string 114 and the connection assembly 133 can be pulled up away from the set packer 102 to perform completion operations, such as space-out and packer fluid displacement procedures. For example, the tubing string 114 can be separated from the packer 102 to space out the tubing to compensate for thermal expansion during well production.

After space-out and packer fluid displacement procedures are done, the seal assembly 134 of the connection assembly 133 can be connected to or stung into the polished bore receptacle 170 of the packer 102 to initiate production. For example, the tubing string 114 can be lowered to dispose at least part of the connection assembly 133 inside the polished bore receptacle 170 to form a fluid seal with the packer 102. Then, a tubing hanger (not shown) of the wellhead 113 is landed inside a wellhead spool at the surface 115 of the wellbore 130 to prepare the tubing string 114 for production. During production, the packer 102 and tubing string 114 are engaged similar to the configuration illustrated in FIG. 2, without the shear pins.

Figure 4:
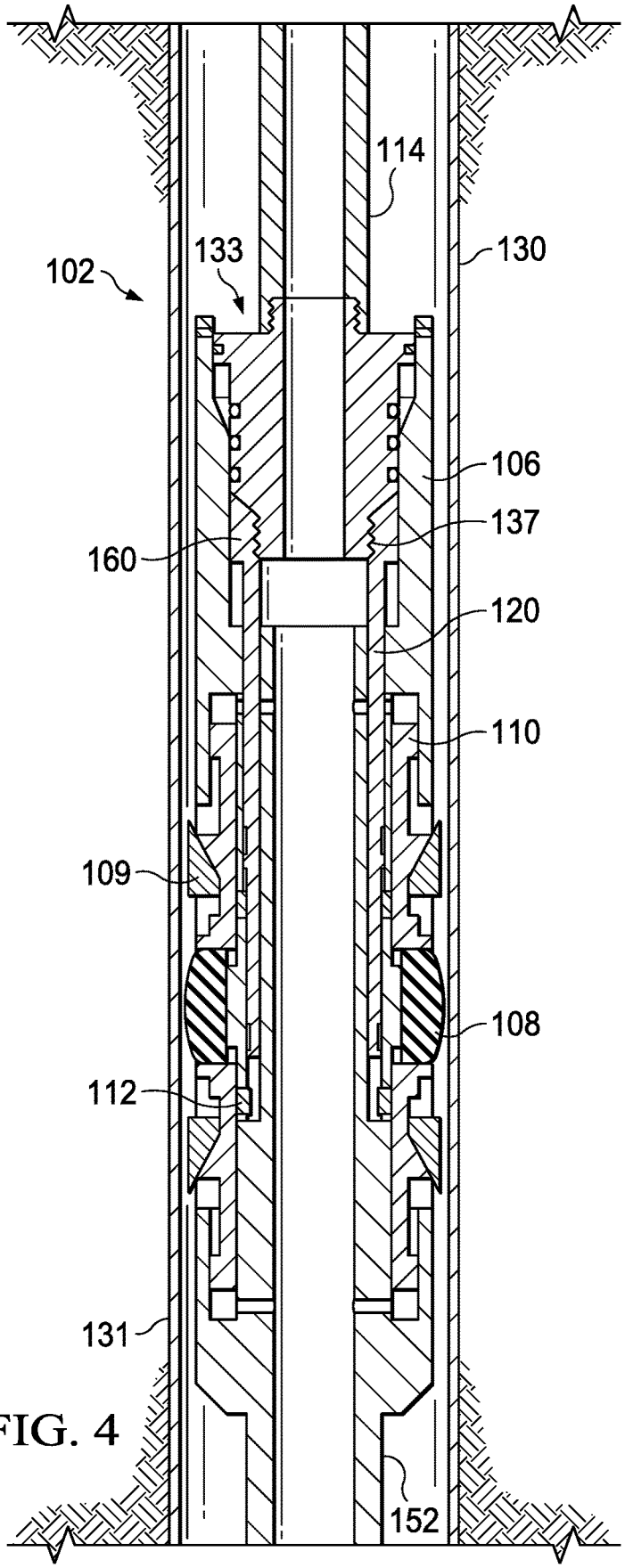
FIG. 4 is a schematic cross-sectional front view of the packer of FIG. 2, connected to the tubing string.

During a workover operation (for example, after years of production), the seal assembly 134 is pulled out of the polished bore receptacle 170 to lay down the tubing hanger (for example, disengaging the tubing hanger from the wellhead spool). Referring to FIG. 4, the tubing string 114 is lowered again (for example, lowered further into the packer than during production) to sting with the seal assembly 134 inside the polished bore receptacle 170 until reaching the internal mandrel 120. The seal assembly 134 engages the mandrel 120 to move the mandrel to unset the packer 102 from the wellbore 130.

Referring to FIGS. 2 and 4, the mandrel 120 is disposed within and movable along the housing 106. The mandrel 120 has a tapped end 160 that connects to a corresponding threaded end 137 of the seal assembly 134. With the threaded end 137 of the seal assembly 134 supported on the mandrel 120, the tubing string 114 is rotated (for example, rotated from a surface of the wellbore 130), to threadedly connect the connection assembly 133 to the internal mandrel 120. As shown in FIG. 4, with the connection assembly 133 attached to the mandrel 120, over-pull is applied to the tubing string 114 to move the mandrel 120 in a direction parallel to the longitudinal axis of the packer 102 away from the tailpipe 152 of the packer 102. The mandrel 120 moves to apply shear force to the locking members 112 holding the pistons 110 to break the locking members 112 to release the pistons 110 and unset the packer 102.

Figure 5:
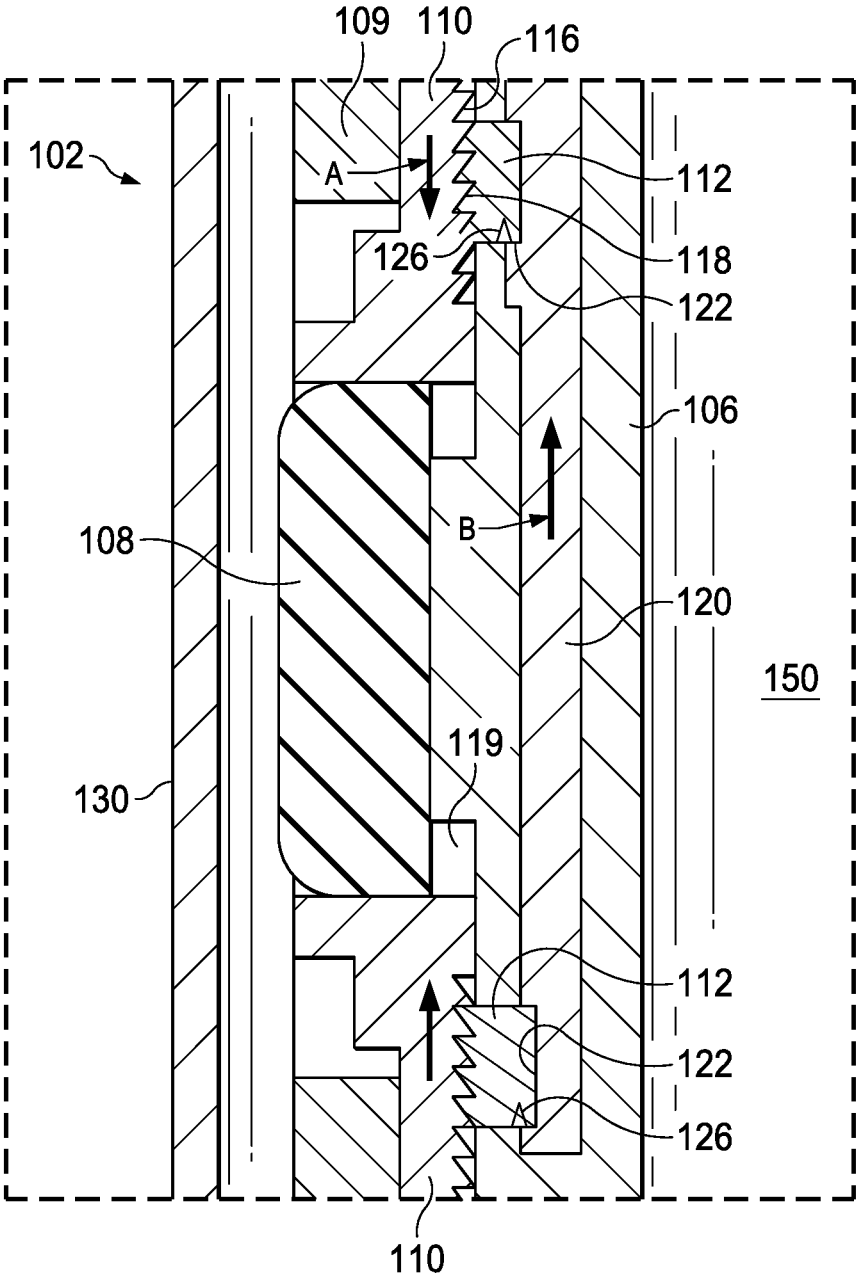
FIG. 5 is a detail view of a portion of the packer of FIG. 2, taken along line 5-5 in FIG. 2.

FIG. 5 illustrates a detail view of the packer 102 showing the arrangement of the internal mandrel 120 and the locking members 112. As described earlier with respect to FIG. 2, the pistons 110 move in a one-way direction parallel to the longitudinal axis of the packer 102 to activate the packer slips 109 and the flexible sealing element 108. Each piston 110 has engageable teeth 116 on a surface of the piston 110 opposite the shoulder 111. The locking members 112 can be locking rings that define teeth 118 extending from an outer surface of the locking ring. The teeth 118 engage the engageable teeth 116 of the piston 110 to constrain movement of the piston 110, with the packer slip 109 and the flexible sealing element 108 set on the wall of the wellbore 130. For example, the locking ring constrains each piston 110 to movement in one direction as the pistons activate the packer slip 109 and the flexible sealing element 108 and ensures that the pistons 110 do not retract along the channel 119, keeping the slips 109 and the flexible sealing element 108 set on the wellbore 130. The one direction in which each piston 110 moves is a direction along the channel 119 of the piston 110 toward the flexible sealing element 108.

With the tubing string 114 attached to the mandrel 120, over-pull can be applied to the tubing string 114 to move the mandrel 120 and release the packer 102 from the wellbore 130. The mandrel 120 is configured to move in a direction parallel to the longitudinal axis (for example, in the same direction as the second set of pistons 110 and in an opposite direction with respect to the first set of pistons 110) of the packer 102 to apply shear force to the locking members 112. For example, each locking member 112 is collapsible to disengage the piston 110 to unset the packer slips 109 and the flexible sealing element 108 responsive to shear force applied by the mandrel 120 to the locking member 112.

Each locking member 112 can have a cut at one side and can be forced fit around the mandrel 120 inside an annular groove 122 of the mandrel. When the mandrel 120 is pulled by the tubing string 114, the annular groove 122 engages each locking member 112 to apply shear force to the engaged locking members 112. Under shear force, the cut of each locking member 112 expands to form a gap inside the locking member 112 and break the locking member 112. With the locking members 112 collapsed or broken, the pistons 110, the packer slips 109, and the flexible sealing element 108 return to their original position (for example, an unset position) to disengage the packer 102 from the wellbore 130. With the packer 102 unset, the mandrel 120 (still attached to the tubing string 114) engages the housing 106 of the packer 102 to retrieve the packer 102.

Figure 6:
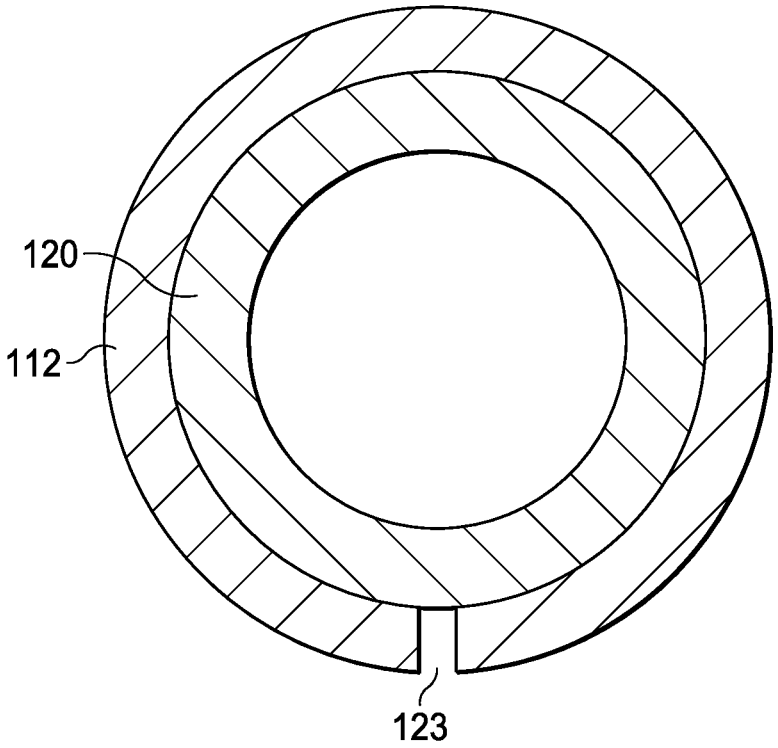
FIG. 6 is a schematic cross-sectional top view of a locking member around a mandrel.
Figure 7:
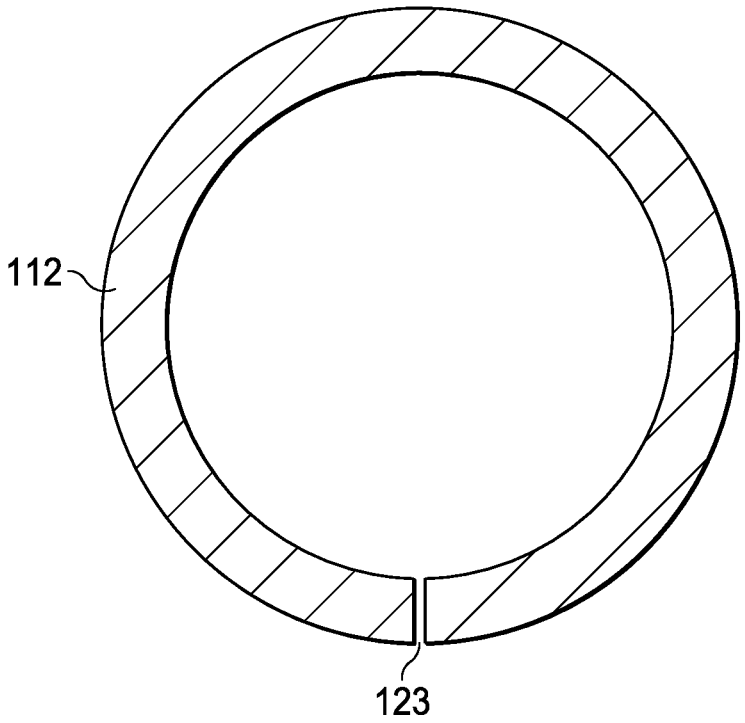
FIG. 7 is a schematic cross-sectional top view of the locking member of FIG. 6 released from the mandrel.
Figure 8:
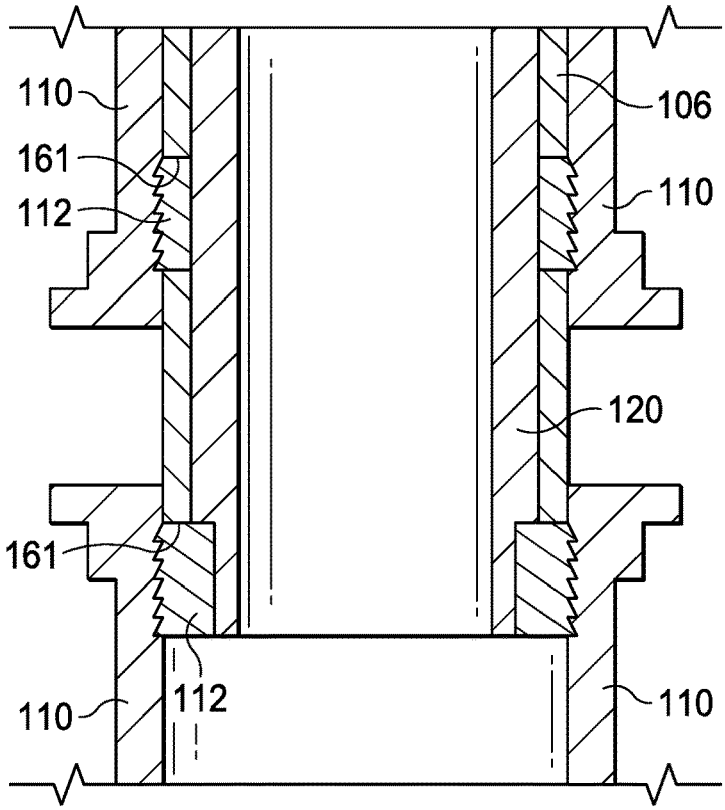
FIG. 8 is a schematic cross-sectional front view of a portion of a packer, according to implementations of the present disclosure.
Figure 9:
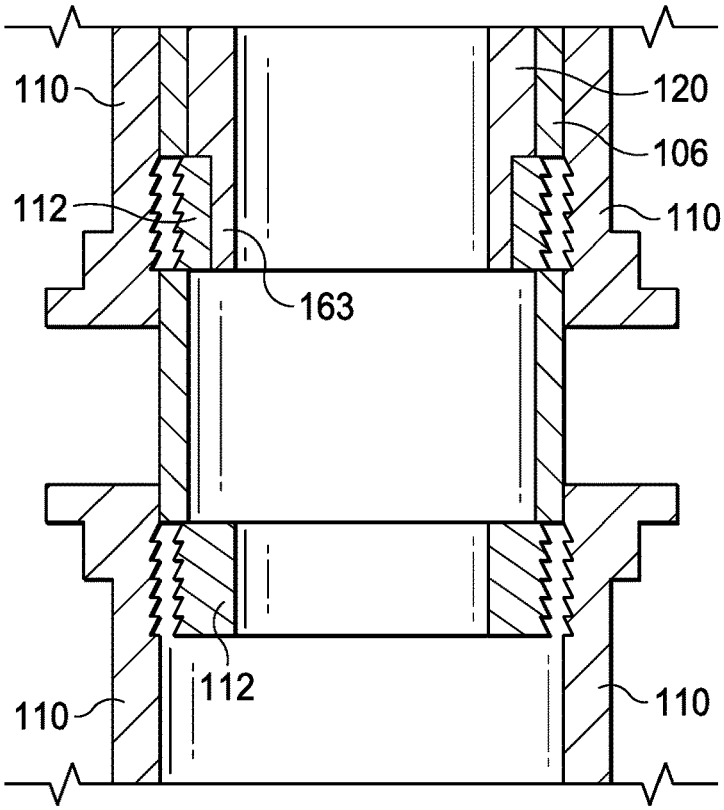
FIG. 9 is a schematic cross-sectional front view of the portion of the packer of FIG. 7, with locking members disengaged.

FIGS. 6-9 show an implementation of a locking member 112 in which the locking member 112 is a locking ring with an outer diameter that increases or decreases to engage or disengage the pistons 110. For example, as shown in FIG. 6, the locking member 112 is a locking ring with a gap 123 that has a width that expands under tension when force fitted around the mandrel 120. FIG. 7 shows the locking ring disengaged from the mandrel 120 (for example, after the mandrel is pulled by the tubing string), with the width of the gap 123 reduced to decrease the outer diameter of the locking ring and disengage the pistons 110. As shown in FIG. 8, the mandrel 120 does not have annular grooves that engage the locking rings. Instead, the locking rings are disposed within radial gaps (or grooves) 161 of the housing 106 of the packer 102 that engage the locking rings to prevent the locking rings (with the locking rings force fitted around the mandrel 120) from moving with the mandrel 120. The mandrel 120 has a portion 163 of reduced outer diameter to allow the rings to retract or collapse to disengage the pistons 110 when the mandrel 120 is pulled by the tubing string 114. For example, when the mandrel 120 is pulled by the tubing string 114, lock pins (not shown) holding the mandrel 120 to the housing 106 are sheared off and the mandrel 120 is free to move along the longitudinal axis of the packer 102. Moving the mandrel 120 upwardly (for example, applying shear force to the inner surface of the locking rings by the outer surface of the mandrel) causes the locking rings to disengage at least part of the mandrel 120. With the locking rings disengaged, a small gap or void may be formed between the top locking rings and the reduced portion 163 of the mandrel 120. Thus, each lock member ring collapses or decreases in diameter inside the radial gap 161 of the housing 106 and disengages the pistons 110 of the packer 102. Therefore, as explained earlier with respect to FIGS. 5-9, 'collapsible' is used to describe a ring or member that is breakable or retractable (for example, able to return to its generally original position after some deformation without breaking) to disengage the pistons.

Figure 10:
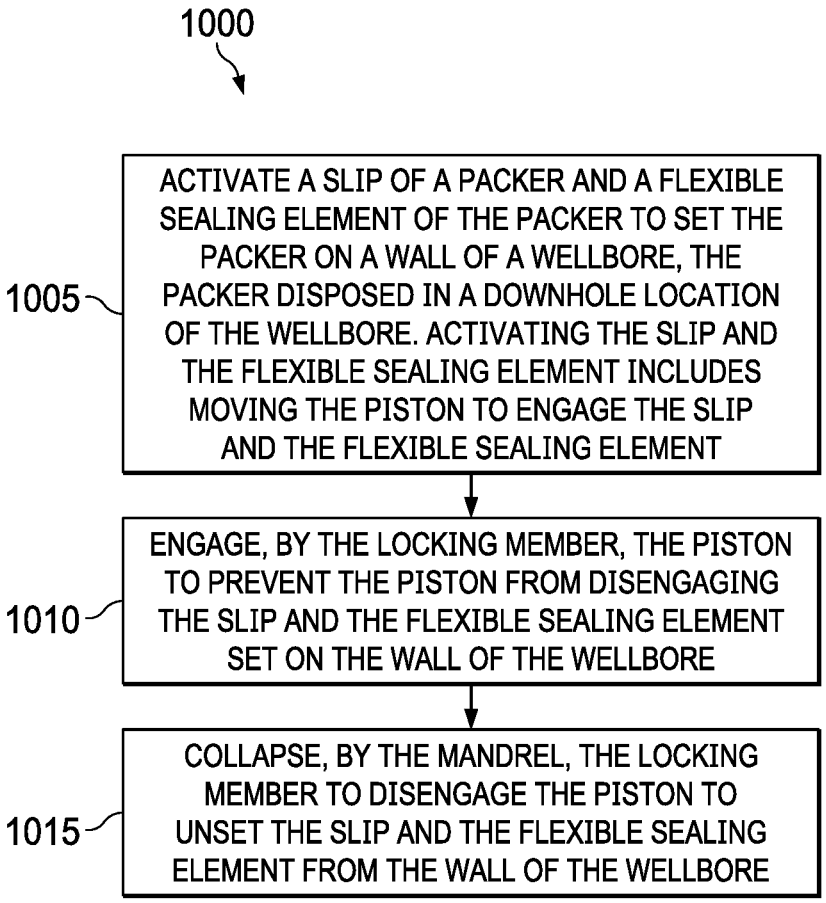
FIG. 10 is a flowchart showing an example method of setting and unsetting a packer on a wellbore.

FIG. 10 illustrates a flowchart of an example method 1000 of setting and unsetting a production packer (for example, the production packer 102 of FIGS. 1-9). The method 1000 includes activating a slip of a packer and a flexible sealing element of the packer to set the packer on a wall of a wellbore. The packer is disposed in a downhole location of the wellbore. The packer includes a housing configured to releasably engage a tubing string disposed in the wellbore. The packer includes the slip, the flexible sealing element, a piston configured to move to activate the packer slip and the flexible sealing element, a locking member configured to engage the piston to constrain movement of the piston, and a mandrel disposed inside the housing. The locking member is collapsible to disengage the piston to unset the packer slip and the flexible sealing element responsive to shear force applied by the mandrel to the locking member. Activating the slip and the flexible sealing element includes moving the piston to engage the slip and the flexible sealing element (1005). The method also includes engaging, by the locking member, the piston to prevent the piston from disengaging the slip and the flexible sealing element set on the wall of the wellbore (1010). The method also includes collapsing, by the mandrel, the locking member to disengage the piston to unset the slip and the flexible sealing element from the wall of the wellbore (1015).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A packer assembly comprising:

a tubing string configured to be disposed in a wellbore; and a packer releasably coupled to the tubing string, the packer comprising, a housing releasably coupled to the tubing string, a packer slip coupled to the housing, a flexible sealing element coupled to the housing, a movable piston coupled to the housing, the movable piston configured to move to activate the packer slip and the flexible sealing element to set the packer slip and the flexible sealing element on a wall of the wellbore, a locking member coupled to the housing, the locking member configured to engage the piston to constrain movement of the piston to keep the packer slip and the flexible sealing element set on the wall of the wellbore, and a mandrel disposed inside the housing, the mandrel configured to connect to the tubing string when the tubing string is released from the housing, wherein the locking member is collapsible to disengage the piston to unset the packer slip and the flexible sealing element responsive to shear force applied by the mandrel to the locking member, the movable piston configured to move in the one direction parallel to a longitudinal axis of the packer to activate the packer slip and the flexible sealing element, and the mandrel configured to move in a same or opposite direction to the movable piston, parallel to the longitudinal axis of the packer to apply shear force to the locking member.

2. The packer assembly of claim 1, wherein the movable piston comprises engageable teeth on a surface of the piston, wherein the locking member is configured to engage the engageable teeth of the movable piston to constrain the movable piston to movement in one direction.

3. The packer assembly of claim 2, wherein the locking member comprises a locking ring defining teeth extending from an outer surface of the locking ring, the teeth configured to engage the engageable teeth of the movable piston to constrain the movable piston to movement in the one direction as the piston activates the packer slip and the flexible sealing element.

4. The packer assembly of claim 1, wherein the tubing string is configured to be threadedly connected to the mandrel to pull the mandrel in the direction parallel to the longitudinal axis of the packer to collapse the locking member.

5. The packer assembly of claim 1, wherein the locking member comprises a locking ring and wherein the housing comprises a radial gap configured to engage the locking ring when the mandrel applies shear force to the locking ring to collapse the locking ring.

6. The packer assembly of claim 5, wherein the locking ring is force fitted around the mandrel, the locking ring comprising a gap comprising a width configured to decrease to reduce an outer diameter of the ring responsive to disengaging at least part of the mandrel.

7. The packer assembly of claim 1, further comprising a connection assembly attached to an end of the tubing string, the housing of the packer releasably attached, with shear pins, to the connection assembly, the connection assembly comprising a threaded end extending beyond the shear pins into the housing and configured to connect to a threaded end of the mandrel when the tubing string is released from the housing.

8. The packer assembly of claim 1, wherein the piston is configured to be activated by fluidic pressure, the housing comprising a fluid channel containing the piston and configured to flow fluid to move the piston.

9. The packer assembly of claim 1, wherein the piston is disposed within a channel of the housing, the piston defining a tapered shoulder extending from a body of the piston, the packer slip and the flexible sealing element disposed along the channel, the tapered shoulder of the piston configured to move the packer slip to set the packer slip on the wall of the wellbore as the piston moves along the channel, an end of the piston configured to push the flexible sealing element to set the sealing element on the wall of the wellbore as the piston moves along the channel.

10. A method comprising:

activating a slip of a packer and a flexible sealing element of the packer to set the packer on a wall of a wellbore, the packer disposed in a downhole location of the wellbore, the packer comprising a housing configured to releasably engage a tubing string disposed in the wellbore, the packer further comprising the slip, the flexible sealing element, a piston configured to move to activate the packer slip and the flexible sealing element, a locking member configured to engage the piston to constrain movement of the piston, and a mandrel disposed inside the housing, the locking member collapsible to disengage the piston to unset the packer slip and the flexible sealing element responsive to shear force applied by the mandrel to the locking member, wherein activating the slip and the flexible sealing element comprises moving the piston to engage the slip and the flexible sealing element;

engaging, by the locking member, the piston to prevent the piston from disengaging the slip and the flexible sealing element set on the wall of the wellbore; and collapsing, by the mandrel, the locking member to disengage the piston to unset the slip and the flexible sealing element from the wall of the wellbore.

11. The method of claim 10, further comprising, prior to collapsing the locking member, engaging, by the mandrel, the tubing string when the tubing string is released from the housing to move with the tubing string, and wherein collapsing the locking member comprises moving the mandrel, by the tubing string, along a longitudinal axis of the packer with the housing engaging the locking member.

12. The method of claim 11, wherein the locking member comprises a locking ring and wherein the housing comprises a radial gap configured to engage the locking ring when the mandrel applies shear force to the locking ring to collapse the locking ring, and wherein collapsing the locking member comprises moving the mandrel along the longitudinal axis of the packer until at least part of the mandrel disengages the locking ring.

13. The method of claim 10, wherein the piston comprises engageable teeth on a surface of the piston, and wherein engaging the piston comprise engaging the engageable teeth of the piston to constrain the piston to movement in one direction.

14. The method of claim 10, further comprising, prior to collapsing the locking member, releasing the housing from the tubing string by breaking, under shear force, shear pins holding the locking member to the tubing string.

15. The method of claim 10, wherein the piston is disposed within and is movable along a channel of the housing, the slip disposed along the channel, and wherein activating the slip comprises moving the piston along a one-way direction along the channel to engage the slip to set the slip on the wall of the wellbore.

16. A production packer comprising:

a tubular housing configured to be disposed in a wellbore, the tubular housing configured to be releasably coupled to a tubing string disposed in the wellbore, a packer slip coupled to the tubular housing, a flexible sealing element coupled to the tubular housing, a movable piston coupled to the tubular housing, the movable piston configured to move to activate the packer slip and the flexible sealing element to set the packer slip and the flexible sealing element on a wall of the wellbore, a locking member coupled to the tubular housing, the locking member configured to engage the piston to constrain movement of the piston, and a mandrel disposed inside the tubular housing, the mandrel configured to connect to the tubing string when the tubing string is released from the tubular housing, wherein the locking member is collapsible to disengage the piston to unset the packer slip and the flexible sealing element responsive to shear force applied by the mandrel to the locking member.

17. The production packer of claim 16, wherein the movable piston comprises engageable teeth on a surface of the piston, and wherein the locking member is configured to engage the engageable teeth of the movable piston to constrain the movable piston to movement in one direction.

18. The production packer of claim 17, wherein the movable piston is configured to move in the one direction parallel to a longitudinal axis of the packer to activate the packer slip and the flexible sealing element, and wherein the mandrel is configured to move in a direction parallel to the longitudinal axis of the packer to apply shear force to the locking member.

19. The production packer of claim 16, wherein the locking member comprises a locking ring and wherein the housing comprises a radial gap configured to engage the locking ring when the mandrel applies shear force to the locking ring to collapse the locking ring.

* * * * *